United States Patent [19]

Evans

[11] 3,990,929

[45] Nov. 9, 1976

[54] SELF-INDUCED TENSION FLOOR

[75] Inventor: Richard J. Evans, Lancaster, Pa.

[73] Assignee: Armstrong Cork Company, Lancaster, Pa.

[22] Filed: Oct. 23, 1975

[21] Appl. No.: 625,082

Related U.S. Application Data

[63] Continuation of Ser. No. 153,872, June 16, 1971, abandoned.

[52] U.S. Cl. ..... 156/71; 156/84; 156/163; 156/219; 156/220; 156/230; 156/249; 156/344

[51] Int. Cl.[2] ..... B32B 31/00

[58] Field of Search ..... 156/71, 84, 163, 219, 156/220, 230, 249, 344

[56] References Cited

UNITED STATES PATENTS

| | | | |
|---|---|---|---|
| 2,913,773 | 11/1959 | Hassel | 264/126 |
| 3,464,178 | 9/1969 | Deichert et al. | 52/309 |
| 3,616,021 | 10/1971 | Valerius | 156/249 |
| 3,654,065 | 4/1972 | Dorogi | 156/219 |
| 3,658,617 | 4/1972 | Fearnow et al. | 156/249 |

*Primary Examiner*—Cameron K. Weiffenbach

[57] ABSTRACT

A method of surfacing an area with a surface covering having a decorative wear layer formed of a thermoplastic vinyl resin-containing composition that has been formed by fusing under heat and/or pressure and bonded to a strippable backing before stresses, set up therein during formation, are relieved. The backing is removed prior to installation and the wear layer secured at its perimeter only against movement with respect to the surface being covered and before stresses therein are relieved.

8 Claims, No Drawings

SELF-INDUCED TENSION FLOOR

CROSS-REFERENCE TO RELATED APPLICATION

This is a continuation of application Ser. No. 153,872, filed June 16, 1971, now abandoned.

BACKGROUND OF THE INVENTION

1. Field of the Invention

The field of the invention relates to installation techniques whereby resilient sheet flooring having a decorative wear layer formed of a thermoplastic resin-containing composition is installed.

2. Description of the Prior Art

It has been recognized that a great number of variables affect the dimensional stability of commercial thermoplastic vinyl resin-containing decorative sheet floor coverings, especially those provided with porous felt backings, which act to retain stresses built into the thermoplastic wear layer. Various methods have been attempted to reduce the stresses (see for instance U.S. Pat. No. 3,339,001) or to take advantage of the stresses built into the thermoplastic wear layer (see for instance U.S. Pat. No. 3,464,178). In accordance with the disclosure of U.S. Pat. No. 3,464,178, it has been recognized that commercial thermoplastic vinyl resin-containing decorative sheet floor coverings, which are formed by bonding thermoplastic compositions to felt backings under heat and pressure, exhibit marked tendencies to shrink on cooling in both the machine and across-machine directions. Thus, it has been proposed to affix these floorings to the surfaces to be covered by adhesively securing the porous backing of the plastic sheet flooring to the substrate at the perimeter of the porous backing layer using an adhesive which forms a permanent bond under the condition of floor use, thus holding the thermoplastic wear layer under restraint such that the wear layer on shrinking remains both buckle and wrinkle-free after installation.

SUMMARY OF THE INVENTION

Observations made on several types of sheet vinyl floor coverings produced on a release-coated felt backing confirm the general thesis of U.S. Pat. No. 3,464,178. This invention concerns the utilization of a strippable felt backing generally in the manufacture of decorative thermoplastic vinyl resin-containing sheet flooring; the rolling of such sheet flooring after manufacture with the wear layer face out; and at the site of installation, the unrolling of the sheet vinyl flooring, the removal of the backing and the securing of the unbacked sheet vinyl flooring to the perimeter of the area to be covered by means such as mechanical fastening means, or adhesive means which forms a permanent bond under the condition of floor use, to form an installation of sheet vinyl surface covering wherein the tension, built into the surface covering during formation and held therein by the bond established with the strippable backing, is retained.

DESCRIPTION OF THE PREFERRED EMBODIMENT

During the manufacture of resilient decorative surface coverings having a wear layer of a thermoplastic vinyl resin-containing composition, the temperatures, utilized to fuse, or to consolidate and fuse, the thermoplastic vinyl resin-containing composition to form the wear layer, often reach temperatures of 340°–400° F. As cooling takes place, the viscosity of the fused vinyl composition wear layer increases. Though both the backing and surface layer are contracting at the same time as the goods cooled, the viscosity of the vinyl becomes great enough so that the vinyl is unable to contract independently of the carrier with which it forms a bond. At this point, the layer of least thermal coefficient of expansion dominates; and since the carrier, such as beater-saturated asbestos felt commonly used in resilient surface coverings, has coefficients about 10 fold, or more, less than those of the fused thermal plastic vinyl resin-containing wear layers, the vinyl layer becomes stressed. This stress relieves itself when the backing is later removed. Thus, until the backing is removed, the wear layer is held in stress thereby.

It is also customary during packaging to roll the sheet goods with the vinyl wear layer face out. This tends to stress the wear layer and, in fact, causes elongation to a limited extent building further stresses into the wear layer. We have found that if the wear layer, on manufacture, is bonded to a strippable backing either by consolidating under heat and pressure, or by fusing the thermoplastic resin-containing composition used to form the wear layer heat alone, that the tensions induced in the wear layer through the conditions utilized in forming and through the physical act of packaging the goods are not relieved until such time as the strippable backing is removed from the wear layer. Thus, if the strippable backing is removed from the decorative thermoplastic vinyl resin-containing composition wear layer at the point of installation and if the wear layer is secured against movement with respect to the surface to be covered only at the perimeter of the wear layer being installed before the stresses in the wear layer can be relieved, the wear layer exhibits a self-induced tension, the fastening at the very perimeter of the sheet restraining the materials in a dimensionally unstable state. This fastening overcomes the tendency of the material to shrink, and the inherent tension keeps the material flat even in a fluctuating environment. This, of course, obviates the need for an overall adhesive system, and the fastening at the very perimeter of the room allows for ease of removal for redecoration. Further advantages are achieved in installations wherein a foamed layer is interposed between the wear surface and the surface being covered. A carpet-type underlayment installation procedure may be used wherein the foamed backing is initially installed prior to securing the wear surface thereover, thus eliminating the need for lamination steps in production and eliminating the need for the use of an intermediate dimensionally stable layer such as glass scrim.

The following examples illustrate several embodiments of the invention.

EXAMPLE 1

A decorative surface covering was made in accordance with the disclosure of Example 1 of U.S. Pat. No. 3,365,353 by doctoring a plastisol coating onto a beater-saturated asbestos felt backing having a methyl cellulose release coat of the type described in Example II of U.S. Pat. No. 2,913,773. The plastisol-coated backing was initially gelled in an oven for approximately 4 minutes at 250° F., and an ink containing a monomer capable of additional polymerization was applied to selected surface portions of the sheet. The ink was dried at 250° F., and the printed sheet was coated with a clear coat of the formulation of Example 3 of U.S. Pat. No. 3,365,353, fused and expanded by placing the sheet in an oven maintained at 370° F. for 6 minutes. A foamed sheet was formed wherein the areas overprinted did not expand. The thickness of the expanded sheet was 45 mils, 35 mils foamed vinyl with a 10-mil clear coat.

The thermal coefficient of expansion of the decorative vinyl resin-containing wear layer was approximately $7.0 \times 10^{-5}$ inches per inch-degree F., and the thermal coefficient of expansion for the beater-saturated asbestos sheet backing material was approximately $0.13 \times 10^{-5}$ inches per inch-degree F. The difference between the thermal coefficients of expansion is $6.87 \times 10^{-5}$. For cooling from 375° F. to 75° F., it would be assumed that the sheet goods would shrink 3 inches per 12 feet of length. However, in actual observations of this material, actual contraction of about 1.5 inches per 12 feet of length was observed. Therefore, it could be assumed that the two layers apparently became married at about 225° F. during the cooling cycle.

When this decorative surface covering material is rolled face out, elongation of the face layer in the roll occurs and both the fact that the wear surface is held under contraction on marriage to the backing layer and that further stresses are built into the wear layer through elongation in rolling for shipment, places internal stresses in the fused thermoplastic vinyl resin-containing composition wear layer.

When this material is unrolled at the installation site, cut if necessary and stripped from its backing, these stresses create a marked tendency towards shrinkage. By mechanically securing the decorative vinyl wear surface at the perimeter of the sheet by mechanical fastening means such as staples, the vinyl sheet is secured against movement with respect to the surface being covered. The stresses in the sheet are unrelieved, and a self-induced tension is thus built into the sheet on installation. This tension maintains the material flat even though the environment is fluctuating in such a manner that such environmental changes acting on an unstressed sheet would cause it to buckle in the absence of the induced tension.

EXAMPLE 2

A filled tessellated vinyl composition decorative surface covering manufactured in accordance with the disclosure of U.S. Pat. No. 3,170,808 and in which the wear layer is bonded to a beater-saturated asbestos felt backing having a methyl cellulose release coat thereon was rolled and transported to the installation site. At the installation site, a foamed backing was initially installed over the area to be decorated and the surface covering unrolled, cut to size, stripped from the felt backing, and placed over the foamed backing layer. It was then secured to the subfloor at the periphery only of the decorative wear layer by means of a thermoset adhesive. The adhesive bond established maintained the vinyl composition wear layer under tension due to the unrelieved stresses maintained therein.

What is claimed is:

1. In a method of installing a resilient decorative surface covering having a wear layer of a fused thermoplastic vinyl resin-containing composition which tends to shrink due to stresses set up therein by the heat history of its manufacturing process, the steps comprising:

1. Bonding the wear layer to a thermally dimensionally stable, strippable backing before the wear layer relaxes, thus holding the wear layer under tension;
2. Packaging the backed product for shipment;
3. At the point of installation, separating said strippable backing from said wear layer; and
4. Securing said wear layer against movement with respect to the surface to be covered at the periphery only of said wear layer before stresses therein are relieved.

2. A method in accordance with claim 1 wherein the wear layer is an embossed foamed layer.

3. A method in accordance with claim 1 wherein the thermal coefficient of expansion of the vinyl composition wear layer is greater than about twice the thermal coefficient of expansion of the backing.

4. A method in accordance with claim 3 wherein the wear layer is installed over a foamed backing.

5. A method of installing a resilient, decorative surface covering, which comprises:

a. providing a resilient, decorative surface covering which comprises a layer of a fused, thermoplastic, vinyl resin which shrinks due to stresses set up therein, by the heat history of its manufacturing process, said layer being adhered to a strippable backing which is of greater dimensional stability under changing thermal conditions than said layer, before said layer shrinks whereby said layer is maintained under tension;
b. separating said strippable backing from said layer; and
c. securing said layer against movement with respect to the surface to be covered, at the periphery only, before the tension in said layer is relieved.

6. The method of claim 5 wherein said layer is an embossed foam layer.

7. The method of claim 5 wherein said decorative surface covering provided in (a) is in a roll with the fused vinyl layer face out.

8. The method of claim 5 wherein said surface to be covered is first covered with a foam backing.

* * * * *